United States Patent [19]

Hori

[11] 4,382,684

[45] May 10, 1983

[54] APPARATUS FOR MIXING AND DISPENSING LIQUID RESINS

[75] Inventor: Nobuo Hori, Kawaguchi, Japan

[73] Assignee: Sanjo Seiki Co., Ltd., Kawaguchi, Japan

[21] Appl. No.: 239,106

[22] Filed: Feb. 27, 1981

[30] Foreign Application Priority Data

Mar. 6, 1980 [JP] Japan ..... 55-028672
Mar. 22, 1980 [JP] Japan ..... 55-036628

[51] Int. Cl.[3] ..... B01F 5/00; B01F 5/06

[52] U.S. Cl. ..... 366/178; 366/192; 366/340

[58] Field of Search ..... 366/336, 337, 338, 339, 366/340, 341, 192, 193, 177, 178, 150; 239/34, 87, 96, 226, 310, 343, 398, 416.4, 416.5, 432, 371; 138/37, 42; 48/180 R, 188, 185; 137/896, 625.4, 874

[56] References Cited

U.S. PATENT DOCUMENTS

| | | | |
|---|---|---|---|
| 693,938 | 2/1902 | Witt | 239/432 |
| 2,758,553 | 8/1956 | Moser | 137/896 |
| 3,532,326 | 10/1970 | Schilling et al. | 366/178 |
| 3,633,823 | 1/1972 | Steiger | 239/96 |
| 3,791,414 | 2/1974 | Anand | 138/37 |
| 3,989,228 | 11/1976 | Morris et al. | 366/77 |
| 4,068,830 | 1/1978 | Gray | 366/339 |
| 4,302,550 | 11/1981 | Pisaric et al. | 366/337 |

*Primary Examiner*—Philip R. Coe
*Assistant Examiner*—Frankie L. Stinson
*Attorney, Agent, or Firm*—Wenderoth, Lind & Ponack

[57] ABSTRACT

An apparatus for mixing and dispensing liquid resins which comprises a mixing unit which is a stationary mixer and a dispersing unit which comprises a dispersing plate placed crossing the line of flow head of the stationary mixer and which has at least one perforation for allowing the materials to be mixed to pass therethrough, a first material supply tube having at least one perforation at the end thereof and which is stuck to the front surface of the dispersing plate for allowing a first material to pass therethrough and a second material supply tube which encloses the first material supply tube and conveys the second material. The structure is effective to cause a time-wise mixing function, because a delay or a time-wise deviation is given to the flow speed of a limited portion of the materials to be mixed, resultantly preventing such a defective mixing function as is caused by a potential discrepancy in commencement time of supply of all the materials to be mixed, from occurring.

6 Claims, 7 Drawing Figures

APPARATUS FOR MIXING AND DISPENSING LIQUID RESINS

TECHNICAL FIELD

The present invention relates to an apparatus for mixing and dispensing liquid resins which is a combination of a resin supplying unit, a hardening agent supplying unit, a mixing unit and preferably a dispensing unit. More specifically, this invention relates to an improvement applicable to an apparatus for mixing and dispensing liquid resins which is a combination of a resin dispersing unit and a static mixing unit.

BACKGROUND OF THE INVENTION

An apparatus for mixing and dispensing liquid resins is widely employed to mold various plastic products which are usually some type of polymers produced by some type chemical reaction such as polymerization carried out predominantly in a mold employing some type of monomers or mixtures of monomers and hardening agents such as bridge formation agents.

Historically, monomers in the form of powder or particles were predominantly utilized. Recently, however, liquid monomers have become preferably utilized. This tendency has revised the technical requirements for such an apparatus for mixing and dispensing resins, because liquid monomers are inclined to allow chemical reaction such as polymerization to commence immediately after monomers are mixed with bridge formation agents.

It is widely known that injectors or extruders have been employed as the apparatus for mixing and dispensing resins in the form of powder or particles. Due to the aforementioned additional requirements caused by the nature of the liquid monomers, the apparatuses for mixing and dispensing resins applicable to liquid resins are required to be provided with additional mixing function. Therefore, the apparatuses for mixing and dispensing liquid resins presently available in the prior art are generally classified into four categories including an advance mixing system, a pre-mixing chamber system, a deformed screw system and a static mixing system.

An advance mixing system is a system which consists of a dispensing unit such as an injector or an extruder and a mixing unit which is installed apart from the dispensing unit and has a function to mix a resin with a hardening agent. In other words, this system consists of two entirely independent units including a mixing unit and a dispensing unit. A resin and a hardening agent are mixed in the mixing unit, before the mixed materials are conveyed and charged to the dispensing unit for the purpose of being dispensed into a mold. In this sense, this system is a type of batch system. Since the hardening reaction commences in the mixing unit, this system is involved with difficulties in conveyance of the mixed liquid resins and in quality control of the molding of plastic products. It is noted, however, the quantity of mixing units can be selected independently from that of dispensing units.

A pre-mixing chamber system is a system which consists of a mixing unit which is a type of agitator and a dispensing unit which usually is an in-line screw injector, both of which are driven by a common drive. Albeit this system could provide a sizable magnitude of operational advantages, this system does not necessarily provide a sufficient magnitude of functional improvement.

A deformed screw system is an improved type of an in-line screw injector. Such an improvement is applied to the shape of screw to improve the mixing function of an in-line screw injector. Since this system is not provided with an independent mixing unit but is an in-line screw injector itself, the structure is considerably simplified in comparison with the pre-mixing chamber system. One of the exemplary models included in this category is disclosed in the U.S. Pat. No. 4,134,688 which is directed to an improved structure of an in-line screw injector. More specifically, the full-flight screw employed in this improved in-line screw injector is provided with an additional mixing unit to improve the kneading function.

A static mixing system is a system which does not have a movable element. In other words, as disclosed by Armeniades et al. in the U.S. Pat. No. 3,286,992, this system consists of a hollow tube containing a series of curved dividing elements each of which has a shape resembling to the fin of a fish. A pump is employed to flow a mixed liquid resins in the tube along the surfaces of curved dividing elements. Due to the three independent functions including flow division, radial mixing and flow inversion, the mixed liquid resins are entirely mixed, before it is dispensed into a mold. Since this system has no movable element, it is clear that a considerable magnitude of advantages is expected from various viewpoints.

However, I have discovered that even this system is involved with a drawback which occurs at the beginnings of each dispensing action which rather frequently occurs. During the short period in the order of several 100 milliseconds at the beginning of each dispensing action, this system is charged with an unmixed material, a material having a relatively lower viscosity, specifically a resin hardening agent. Since no mixing function is expected for this system unless plural materials are supplied simultaneously, this means a lump of an unmixed material is dispensed into a mold at an unpresumable point of time during a dispensing action. This of course causes an unsatisfactory molding quality for a produced plastic product. Particularly because a continuous operation is not necessarily realistic for this system and because it is difficult to presume the location where such molding faults appear in a plastic product, this is a drawback which cannot be ignored.

OBJECTS AND SUMMARY OF THE INVENTION

An object of this invention is to provide an apparatus for mixing and dispensing liquid resins based on the static mixing system which is free from such a faulty mixing function which is inevitable for a static mixing system.

Based on the results of various experiments, I assume that a potential discrepancy in commencement time of supply of the materials to be mixed may be the most essential parameter causing such a lump of unmixed material and resultantly a defective mixing function. In other words, my assumption is that albeit a stationary mixer has a very good efficiency in the geometrical mixing function, it has a quite marginal efficiency in the time-wise mixing function, which is defined as a mixing function in which plural materials are mixed by varying the flow rate of each individual element. If my assumption is correct, a simultaneous commencement of supply of all the materials to be mixed would be effective to prevent such a defective mixing function from occurring. This concept would be realized, if a static mixing system is provided with an additional unit having a time-wise mixing function defined in the above. More specifically, the above concept would be reduced to practice by addition of an additional unit which makes the flow rate non-uniform for each individual particle constituting such a lump of material which is simultaneously dispensed, to a stationary mixer. In other words, if a deviation is given to the flow speed of a lump of material simultaneously supplied, such a defective mixing function as is caused by a potential discrepancy in commencement time of supply of all the materials to be mixed, is prevented from occurring.

The results of various experiments proves the above concept has been successfully reduced to practice in an apparatus for mixing and dispensing liquid resins based on the static mixing system which is additionally provided with a dispersing unit comprising (1) a dispersing plate having at least one perforation (dispersing plate perforation) thereon to allow passage therethrough for all the materials to be mixed, (2) at least one material supply tube (first tube) of which one end sticks to the surface of the dispersing plate and which is provided with at least one perforation (supply tube perforation) in the neighborhood of the above mentioned one end of the material supply tube (first tube) and at the geometrical position which does not allow the supply tube perforation to directly face with the dispersing plate perforation, in the line of flow ahead of the stationary mixer, and (3) another material supply tube (second tube) which encloses the first tube and sticks to the external circle of the dispersing plate to confine the materials in the dispersing unit.

If plural dispersing plates are employed, an apparatus for mixing and dispensing liquid resins with the enhanced time-wise mixing function is available.

To increase the operational advantages, a modification is available for the above mentioned apparatus for mixing and dispensing liquid resins by addition of a dispensing unit consisting of a nozzle adapter and a nozzle head. The nozzle adapter has a piston slidably provided in a piston hole bored in the nozzle adapter. The piston is provided with a poppet which moves together with the piston. The nozzle adapter is further provided with at least one passage which connects the internal space of a stationary mixer and the rear end of the nozzle adapter. The nozzle head has a nozzle hole which is open or closed with the above mentioned piston and has an internal space which connects the above mentioned passage which connects the internal space of the stationary mixer and the rear end of the nozzle adapter, and the nozzle hole.

BRIEF DESCRIPTION OF THE DRAWINGS

The present invention, together with its various features and advantages, can be readily understood from the following more detailed description presented in conjunction with the following drawings, in which.

PRIOR ART STATEMENT

Prior to the description of the preferred embodiments of the present invention, three independent prior art static mixing systems disclosed respectively in the U.S. Pat. Nos. 4,068,830; 3,861,652 and 4,124,309 will be briefly described in order to specifically point out the drawbacks thereof, which the present invention may overcome as will be described in detail hereinafter.

A static mixing system disclosed in the U.S. Pat. No. 4,068,830 is provided with at least one perforated plate in the line of flow ahead of a conventional stationary mixer. Albeit this is effective to improve the mixing function particularly for liquids widely different viscosities to a limited extent, the expected magnitude of the improvement is rather limited.

A static mixing system disclosed in the U.S. Pat. No. 3,861,652 is provided with a screen structure placed between groups of static mixing elements. This may be effective to overcome the problem of undissolved high viscosity inhomogeneities in a conventional stationary mixer.

A static mixing system disclosed in the U.S. Pat. No. 4,124,309 is provided with one or more dispersion devices with which a mixture of liquids containing pulverized solid power to be dispersed is jetted through a single or a plurality of unit dispersers to a relatively wider gap portion than a nozzle to impinge upon wall surfaces to change the direction of the liquid flow. This is effective to produce a super highly dispersed material and with a minimum amount of agglomerated particles.

All of these static mixing systems are based on the assumption that plural liquids exist in a flow pass at the same time. In other words, the mixing function of these static mixing system is limited to the geometrical mixing function, lacking the time-wise mixing function. Therefore, these are not effective to disperse lumps of unmixed materials potentially caused by discrepancy in commencement time of supply of all the materials to be mixed. This causes such lumps of unmixed materials to be dispensed from the static mixing system without being mixed with the other materials.

DETAILED DESCRIPTION OF PREFERRED EMBODIMENTS

Figure 1:
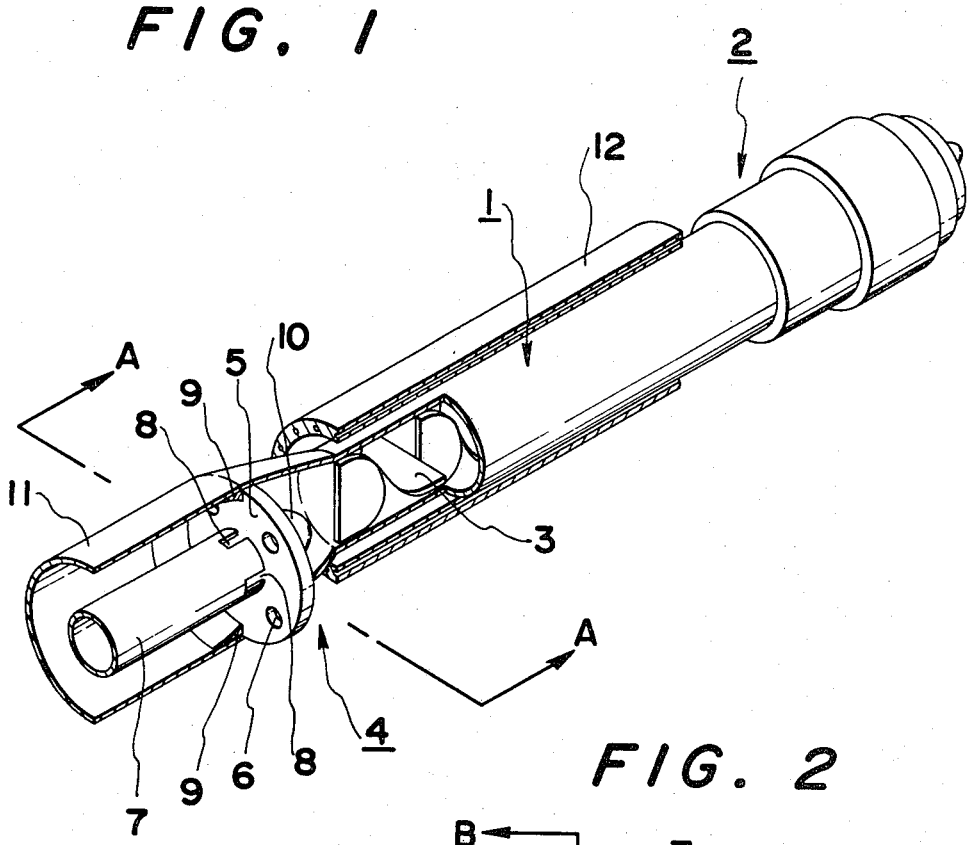
FIG. 1 shows a partially cutaway perspective view of an apparatus for mixing and dispensing liquid resins in accordance with one embodiment of the present invention.
Figure 2:
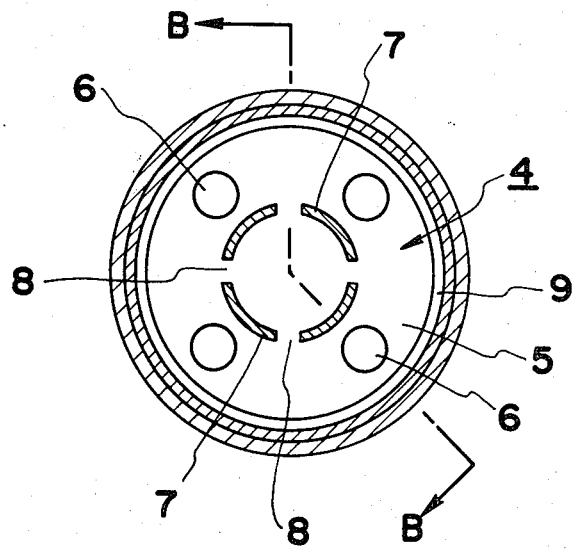
FIG. 2 shows a cross-sectional view of FIG. 1 taken along line A—A.
Figure 3:
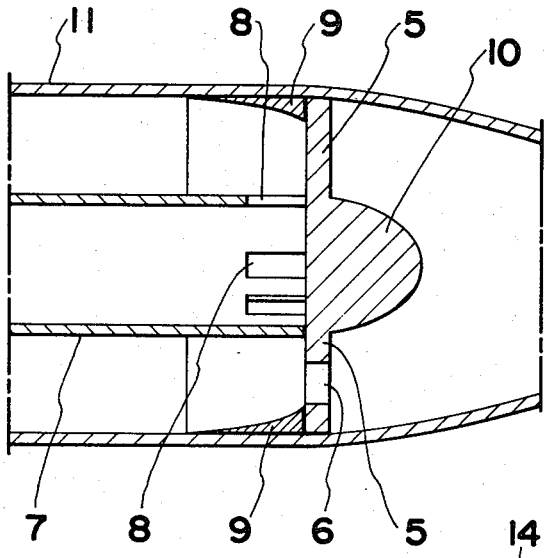
FIG. 3 shows a cross-sectional view of FIG. 2 taken along line B—B.

Referring to FIGS. 1 through 3, the reference numeral 1 indicates a mixing unit provided with a dispensing unit 2 at the rear end thereof. The reference numeral 3 is a stationary mixer placed in the line of flow ahead of the dispensing unit 2. Further ahead of the stationary mixer 3 placed is a dispersing unit 4 which consists of a dispersing plate 5 and a first material (hardening agent) supply tube 7 both of which are housed in a second material (resin) supply tube 11. The dispersing plate 5 which is placed crossing the axis of the mixing unit 1 is provided with plural perforations 6. The first material (hardening agent) supply tube 7 which sticks to the wall portion (a portion where there are no perforations) of the dispersing plate 5 is provided with plural perforations 8 of which the positions are selected not to directly face with the dispersing plate perforations 6.

A circular guide 9 leads the materials to be mixed toward the dispersing plate perforations 6. A projection 10 provided at the rear surface of the dispersing plate 5 smooths the flow. Ahead of the dispersing plate 5 provided is the second material (resin) supply tube 11 which encloses the first material (hardening agent) supply tube 7. The external surface of the mixing unit 1 which houses the stationary mixer 3 is cooled by a cooling jacket 12.

When an apparatus for mixing and dispensing liquid resins with the aforementioned structure is employed to mold a plastic product, a resin such as epoxy resin, polyester, urethane, silicon rubber, is supplied to the mixing unit 1 through the second material (resin) supply tube 11. Most portion of the second material (resin) flowing along the second material (resin) supply tube 11 turns its flow direction and makes a fairly complicated movement, such as whirling, after it bumps the dispersing plate 5. Thereafter, it flows into the mixing unit 1 through the dispersing plate perforations 6. This causes somewhat of a delay or a timewise deviation for the flow speed of a limited portion of the more viscous and naturally slower moving second material (resin), resultantly causing stagnancy for such a limited portion of the second material.

On the other hand, a relatively fast moving first material (hardening agent) having a relatively lower viscosity flowing through the first material (hardening agent) supply tube 7 bumps the dispersing plate 5, before it flows through the supply tube perforations 8 in the radial direction toward the internal space of the second material supply tube 11, so that the first material (resin hardening agent) is allowed to flow into the second material (liquid resin) flowing inside the second material supply tube 11 in the manner expediting the mixing function of the both materials. This movement causes a delay or a time-wise deviation for the flow speed of a limited portion of the first material (hardening agent), resultantly causing stagnancy for such a limited portion of the first material. Since the positions of the supply tube perforations 8 are selected not to allow them to directly face the dispersing plate perforations 6, the aforementioned delay or a time-wise deviation caused for the flow speed of the limited portions of each material is enhanced.

Thus, two materials, resin and hardening agent, stay in the neighborhood of the dispersing plate 5 for a while and makes complicated movement, which is effective to perform a time-wise mixing function.

After lumps of an unmixed material potentially caused by discrepancy in commencement time of supply of the both materials are dispersed, the materials to be mixed are guided by the circular guide 9 into the stationary mixer 3 through the dispersing plate perforations 6 of the dispersing plate 5. Thereafter, the materials to be mixed are thoroughly mixed in the stationary mixer 3 by the mixing functions including flow diversion, radial mixing and flow inversion.

Figure 4:
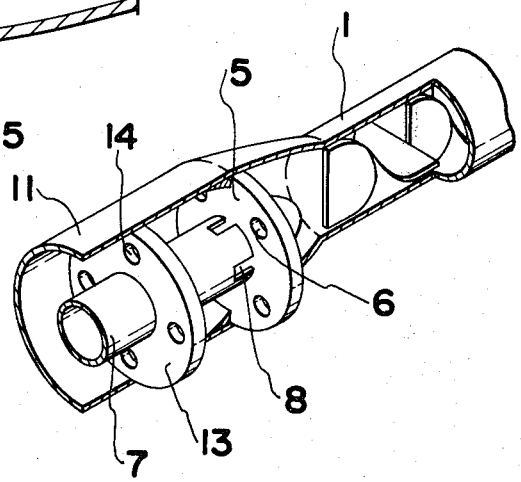
FIG. 4 shows a partially cutaway perspective view of an apparatus for mixing and dispensing liquid resins in accordance with another embodiment of the present invention.
Figure 5:
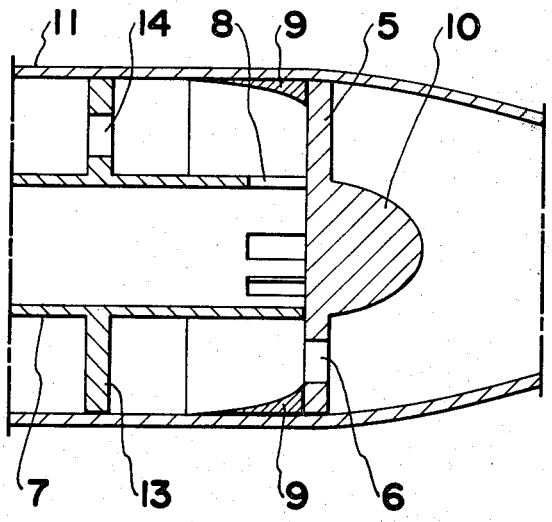
FIG. 5 shows a cross-sectional view of FIG. 4 taken along the axis thereof.

Referring to FIGS. 4 and 5, an apparatus for mixing and dispensing liquid resins in accordance with another embodiment of the present invention is provided with an additional dispersing plate 13 placed in the line of flow ahead of the dispersing plate 5. Perforations 14 of the additional dispersing plate 13 are positioned not to allow them to directly face the dispersing plate perforations 6 of the dispersing plate 5.

The apparatus for mixing and dispensing liquid resins provided with the aforementioned additional dispersing plate 13 in addition to the structure essential for the embodiment shown in FIGS. 1 through 3 has an additional mixing function to improve the mixing performance to a considerable extent, because none of the individual particle contained in the materials to be mixed is allowed to pass through both dispersing plate perforations 14 and 6 without bumping the dispersing plate 5. As a result, the entire quantity of the materials to be mixed receives the effects causing a delay or a time-wise deviation for the flow speed of the limited portions thereof. In other words, none of the limited portions of the materials to be mixed are allowed to pass through the dispersing unit 4, without receiving the effects causing such stagnancy for a limited portion of the materials.

It is needless to emphasize that the more additional dispersing plates are employed, the more the mixing efficiency is improved.

Figure 6:
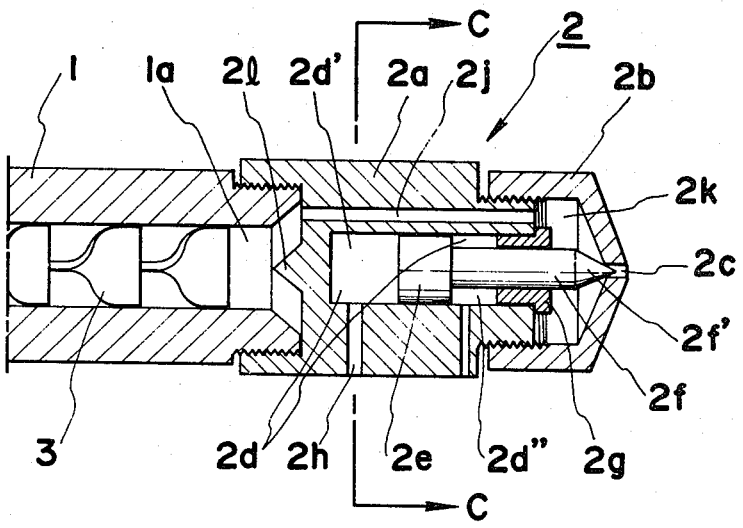
FIG. 6 shows a cross-sectional view of the dispensing unit of an apparatus for mixing and dispensing liquid resins in accordance with one modification of the present invention.
Figure 7:
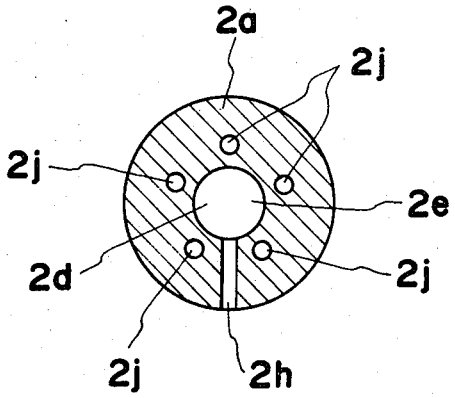
FIG. 7 shows a cross-sectional view of FIG. 6 taken along line C—C.

Referring to FIGS. 6 and 7 which illustrates the dispensing unit 2 of an apparatus for mixing and dispensing liquid resins in accordance with a modification of the present invention, a nozzle adapter 2*a* is removably screwed to one end of the mixing unit 1 containing the stationary mixer 3. A nozzle 2*b* having a nozzle hole 2*c* at one end thereof is removably screwed to one end of the nozzle adapter 2*a*. A cylinder hole 2*d* is bored in the nozzle adapter 2*a* along the axis thereof. A piston 2*e* is inserted slidably in the cylinder hole 2*d*. The piston 2*e* is attached with a poppet 2*f* which moves together with the piston 2*e* along the axis of the nozzle adapter 2*a* to open or close the nozzle hole 2*c* of the nozzle 2*b*. A poppet guide 2*g* is removably provided at the open end of the cylinder hole 2*d* for two independent purposes including the closure of the open end of the cylinder hole 2*d* and the guide of the poppet 2*f*. A hydropressure is supplied to a space 2*d'* of the cylinder hole 2*d* which is behind the piston 2*e* through a hydropressure supply hole 2*b*. Another hydropressure is supplied to a space 2*d''* of the cylinder hole 2*d* which is between the piston 2*e* and the poppet guide 2*g*. These hydropressures are employed to move the piston 2*e*.

Referring to FIG. 7, plural resin passages 2*j* are bored in the nozzle adapter 2*a* along the axis thereof for the purpose to connect the internal space 1*a* of the mixing unit 1 and the internal space 2*k* of the nozzle 2*b*. The nozzle adapter 2*a* is provided with a flow smoothing projection 2*l* at the front surface thereof.

The materials to be mixed, such as resins and hardening agents, after being completely mixed in the dispersing unit 4 and the stationary mixer 3 housed in the mixing unit 1, flow into the internal space 2*k* of the nozzle 2*b* through the resin passages 2*j*, before being dispensed into a mold through the nozzle hole 2*c*.

After the action to supply the mixed materials into a mold is finished, a hydropressure is supplied to the space 2*d'* of the cylinder hole 2*d* which is behind the piston 2*e* through the hydropressure supply hole 2*h*. The hydropressure causes the piston 2*e* together with the poppet 2*f* to move to the right in the drawing along the poppet guide 2*g* and to close the nozzle hole 2*c* of the nozzle 2*b*. Thereafter, the mixing unit 1 is moved to detach the dispensing unit 2 from the mold, before the mold is opened. Since the nozzle hole 2*c* of the nozzle 2b is entirely closed with the poppet 2f, the mixed materials remaining under a high pressure in the mixing unit 1 and in the dispensing unit 2 are not allowed to leak from the nozzle hole 2c.

When the next cycle of molding is carried out, the mixing unit 1 is moved to cause the dispensing unit 2 to contact with a mold. The hydropressure in the space 2d' of the cylinder hole 2d which is behind the piston 2e is released through the hydropressure supply hole 2h. The pressure of the mixed materials in the internal space 2k causes the poppet 2f together with the piston 2e to move to the left in the drawing. As a result, the nozzle hole 2c is opened to allow the mixed materials to be dispensed into a mold. It is of course effective to employ the hydropressure in the other space 2d'' in addition to that in the space 2d' for the purpose to expedite the movement of the piston 2e.

What is claimed is:

1. An apparatus for mixing and dispensing liquid resins, comprising:

(a) a stationary mixer housed in a mixing unit; and (b) a dispersing unit, including means for providing delayed mixing of a first liquid resin and a second liquid resin having a viscosity greater than the viscosity of the first liquid resin, respectively flowing in a first axial direction, and for diverting flow of the first liquid resin radially and angularly with respect to the direction of flow of the second liquid resin, said means including:

(1) a first dispersing plate crossing a line of flow upstream of said stationary mixer, having an upstream facing surface, said upstream facing surface having:

(A) a perforationless portion having a first outer boundary, (B) a second outer boundary surrounding said first outer boundary in spaced relation thereto, and (C) at least one first perforation provided between said first and second boundaries for allowing passage of said first and second liquid resins to be mixed downstream thereof, (2) a first tube having:

(A) an end fixed in abutment to said upstream facing surface along said first outer boundary so as to surround said perforationless portion of said upstream facing surface, and (B) at least one second perforation upstream of said first dispersing plate at said end thereof, spaced from said at least one first perforation circumferentially along the outer periphery of said first tube, for allowing passage of said first liquid resin, and (3) a second tube surrounding said at least one first perforation along said second outer boundary, provided upstream of said first dispersing plate, and enclosing said first tube, for allowing passage of said second liquid resin;

whereby said first liquid resin is directed by said first dispersing plate and said first tube through said at least one second perforation radially and angularly with respect to the direction of flow of the second liquid resin and is delayed thereby in its downstream movement before passing through said at least one first perforation together with said second liquid resin.

2. An apparatus for mixing and dispensing liquid resins as in claim 1, wherein the interior of said first tube is in direct fluid communication with the outer peripheral surface of said first tube along the entire boundary of said at least one second perforation.

3. An apparatus for mixing and dispensing liquid resins, as in claim 1, wherein the interior of said first tube is in direct fluid communication with said at least one first perforation.

4. An apparatus as in claim 1 or claim 3, wherein said at least one first perforation comprises a plurality of small perforations spaced circumferentially about said first outer boundary.

5. An apparatus for mixing and dispensing liquid resins defined in claim 1 further comprising at least one second dispersing plate having at least one perforation located upstream of said first dispersing plate.

6. An apparatus for mixing and dispensing liquid resins defined in claim 1 which further comprises a dispensing unit provided at the rear end of said mixing unit, which dispensing unit comprises:

a nozzle adapter having a piston slidably provided in a piston hole bored therein and which piston is provided with a poppet and which nozzle adapter is provided with at least one passage connecting the internal space of said stationary mixer and the rear end of said nozzle adapter and a nozzle head having a nozzle hole which is open or closed with said piston and which nozzle hole is provided with an internal space which connects said passage connecting said stationary mixer and the rear end of said nozzle adapter, and said nozzle hole.

* * * * *